US012352529B2

(12) United States Patent
Welintukonis

(10) Patent No.: US 12,352,529 B2
(45) Date of Patent: Jul. 8, 2025

(54) HOLSTER, HOLSTER ACCESSORY, AND RELATED METHODS

(71) Applicant: Mark Welintukonis, Willimantic, CT (US)

(72) Inventor: Mark Welintukonis, Willimantic, CT (US)

( * ) Notice: Subject to any disclaimer, the term of this patent is extended or adjusted under 35 U.S.C. 154(b) by 514 days.

(21) Appl. No.: 17/842,185

(22) Filed: Jun. 16, 2022

(65) Prior Publication Data

US 2023/0027392 A1 Jan. 26, 2023

Related U.S. Application Data

(60) Provisional application No. 63/225,091, filed on Jul. 23, 2021.

(51) Int. Cl.
*F41C 33/04* (2006.01)
*F41C 33/02* (2006.01)

(52) U.S. Cl.
CPC ..... *F41C 33/048* (2013.01); *F41C 33/0227* (2013.01); *F41C 33/041* (2013.01)

(58) Field of Classification Search
CPC .. F41C 33/048; F41C 33/0227; F41C 33/041; F41C 33/02; F41C 33/006; F41C 33/0209; F41C 33/046
USPC ..... 224/183
See application file for complete search history.

(56) References Cited

U.S. PATENT DOCUMENTS

| | | | | |
|---|---|---|---|---|
| 8,332,967 | B2 | 12/2012 | Echikson | |
| 8,769,780 | B1 | 7/2014 | Segel | |
| 9,204,676 | B2 | 12/2015 | Gbadamosi | |
| 9,746,299 | B1 | 8/2017 | Davis | |
| 10,063,271 | B1 * | 8/2018 | Goldshtein | H04M 1/185 |
| 10,309,433 | B2 * | 6/2019 | Salvatore | F16B 1/00 |
| 10,856,595 | B2 | 12/2020 | Bunting | |
| 11,150,050 | B2 * | 10/2021 | Gordon | A45F 5/021 |
| 11,696,634 | B2 * | 7/2023 | Schori | A41D 27/20 224/183 |
| 11,986,083 | B2 * | 5/2024 | Stutz | A44B 99/00 |
| 2008/0201910 | A1 | 8/2008 | Schoening et al. | |
| 2013/0254976 | A1 | 10/2013 | Aravena | |

* cited by examiner

*Primary Examiner* — Corey N Skurdal
(74) *Attorney, Agent, or Firm* — PatentXL Law Firm

(57) ABSTRACT

A firearm holster has a holster body that includes a plurality of walls defining a encasement for the firearm and an opening for inserting the firearm into that encasement. The walls include an interior wall, as well as an exterior wall disposed opposite the interior wall. The holster also includes a first magnetic element disposed on the holster body, and a second magnetic element that is configured to cooperate with the first magnetic element to magnetically attract the first and second magnetic elements to one another. The second magnetic element includes a coupler for coupling the second magnetic element to an article of clothing.

15 Claims, 13 Drawing Sheets

HOLSTER, HOLSTER ACCESSORY, AND RELATED METHODS

CROSS-REFERENCE TO RELATED APPLICATION

This application claims the filing date benefit of U.S. Provisional Application No. 63/225,091, titled Holster, Holster Accessory, and Related Methods, filed Jul. 23, 2021, the entire contents of which are hereby incorporated by reference herein.

TECHNICAL FIELD

The present disclosure is generally related to holsters for carrying a firearm and, more particularly, to holsters and related accessories that facilitate concealment of the holster and/or firearm carried on the body of a person.

BACKGROUND

Undercover police officers, security personnel and many common citizens often carry a weapon such as a firearm on their bodies. A known device for carrying a firearm is a holster. One type of holster is one that is designed to be worn at or near a person's waist area, and could be securable to a person's belt, for example. Other known types include holsters intended to be worn near the person's torso, under the armpit, and may—to that end—include a strap allowing securement of the holster around the person's shoulder. Certain types of holsters are designed to be secured to a belt or the pants of the wearer, and is intended to be worn interiorly of the person's waist (these may be known as "inside the waistband holsters") or exteriorly of the person's waist. Yet other types of holsters may be designed to be secured around a person's thighs or near the ankles, for example.

For those that carry a firearm in a holster, or even an empty holster, a common concern is concealment i.e., the desire to hide the weapon and/or holster from view, for example as a means to minimize the potential reaction of other persons that may be afraid of firearms, or as a means for the weapon-carrier to hide his or her identity as an officer of the law (e.g., undercover police officer). Unfortunately, concealment has challenges that are not easily overcome. For example, concealment by means of an oversized garment such as a very large shirt may look unnatural on the firearm carrier, thereby leading to an assumption by others that the carrier has a firearm and/or holster on his or her body, thereby defeating the purpose of the designed concealment in the first place. Further, normal movement of the person carrying a weapon (i.e., the firearm carrier) in a holster, such as walking, running, leaning, or bending over, may result in undesirable, inadvertent exposure of the firearm and/or holster, particularly when the holster is carried in the person's waist area.

It would be desirable, therefore, to address the shortcomings described above as well as others in connection with the desire of a firearm carrier to conceal his/her weapon and/or holster for carrying such weapon.

SUMMARY

In one embodiment, a firearm holster has a holster body that includes a plurality of walls defining an encasement for the firearm and an opening for inserting the firearm into that encasement. The walls include an interior wall, as well as an exterior wall disposed opposite the interior wall. The holster also includes a first magnetic element disposed on the holster body, and a second magnetic element that is configured to cooperate with the first magnetic element to magnetically engage the first and second magnetic elements with one another. The second magnetic element includes a coupler for coupling the second magnetic element to an article of clothing.

The first magnetic element may be disposed on the exterior wall of the holster body. Additionally or alternatively, the first magnetic element may include at least one magnet. The first magnetic element may have a total effective magnetic pull force of less than about 11 Newtons. In a specific embodiment, the first magnetic element has a total effective magnetic pull force of less than about 9 Newtons, or between about 4 and about 9 Newtons, or even less than about 4 Newtons. In certain embodiments, the first magnetic element is free of magnets. The second magnetic element may include at least one magnet. Additionally or alternatively, the second magnetic element may have a total effective magnetic pull force of less than about 11 Newtons, or even a total effective magnetic pull force of less than about 9 Newtons, or between about 4 and about 9 Newtons, or even less than about 4 Newtons.

In specific embodiments, the first magnetic element includes at least one magnet and has a total effective magnetic pull force no greater than about 52 Newtons. Yet in other specific embodiments, the first magnetic element includes two magnets, each having a nominal pull force in the range between about 19 Newtons and about 26 Newtons, while the second magnetic element includes a ferrous metallic plate and a layer of rubberized material disposed on the ferrous metallic plate.

The second magnetic element, in specific embodiments, is free of magnets. At least one of the first or second magnetic elements may include a neodymium magnet. The first magnetic element may be integrally formed with the holster body. Alternatively, the first magnetic element may be permanently attached to the holster body or may be instead releasably attached to the holster body. The holster body may include a holster belt clip that is configured for mounting the firearm holster over a belt, with the first magnetic element being disposed on that holster belt clip. In specific embodiments, at least one of the first or second magnetic elements includes at least one magnet and a layer of plastic material that is disposed over the at least one magnet. The layer of plastic material may be a rigid plastic material and/or include polyurethane.

The coupler of the second magnetic element, in specific embodiments, includes a piercing pin and a clasp, with the piercing pin having a piercing end and being configured to be inserted through a layer of the article of clothing for releasably coupling the second magnetic element to that article of clothing. The clasp in those embodiments is configured to retain the piercing end of the piercing pin when the second magnetic element is coupled to the article of clothing. The coupler may include a biasing element that is coupled to one end of the piercing pin, with the coupler having an open position in which the piercing end is away from the clasp, and a closed position in which the piercing end is retained in the clasp. The biasing element urges the coupler toward the open position of the coupler. The biasing element may, for example, be in the form of a spring. The coupler may take one of various forms and in that regard may include one of a hook and loop fastener, a temporary adhesive, a clamp, or a resilient clip that is configured to releasably couple the second magnetic element to the article of clothing.

In another embodiment, a firearm concealment system is configured for use by a person carrying a firearm in that person's waist area and who is wearing an article of clothing. The system includes a waist mounting device that is configured for securement to the waist area of the person, with that waist mounting device including a device body and a first magnetic element that is disposed on the device body. The system also includes a second magnetic element that is configured to cooperate with the first magnetic element to magnetically engage the first and second magnetic elements with one another. Magnetic engagement between the first and second magnetic elements is effective to secure a position of at least a portion of the article of clothing relative to the device body.

The second magnetic element in that embodiment includes a coupler for releasably coupling the second magnetic element to the article of clothing. In a specific embodiment, the waist mounting device includes a resilient belt clip, with that resilient belt clip including first and second plates that are disposed opposite one another, and which are configured to lie respectively against each of the two opposite surfaces of a belt worn by the person, with the first and second plates being pivotally connected to one another at respective proximal ends of those plates and being biased toward one another when pulled apart.

In another specific embodiment, the waist mounting device includes first and second plates and a connector, with the first and second plates being configured to lie respectively against each of the two opposite surfaces of a belt worn by the person and with the connector being configured to selectively secure the first and second plates relative to the belt and relative to one another. The waist mounting device may include a flexible belt or strap that is configured for securement around the waist of the person, with the device body being coupled to that flexible belt or strap. The first magnetic element may include at least one magnet, and that first magnetic element may have a total effective magnetic pull force of less than about 11 Newtons, or even a total effective magnetic pull force of less than about 9 Newtons, or between about 4 and about 9 Newtons, or even less than about 4 Newtons. The first magnetic element may, alternatively, be free of magnets.

The second magnetic element may include at least one magnet, and the second magnetic element may have a total effective magnetic pull force of less than about 11 Newtons or even less than about 9 Newtons, or between about 4 and about 9 Newtons, or even less than about 4 Newtons. The second magnetic element may, alternatively, be free of magnets. At least one of the first or second magnetic elements may include a neodymium magnet. The first magnetic element, in specific embodiments, is integrally formed with the device body. In other specific embodiments, the first magnetic element is permanently attached to the device body, or may instead be releasably attached to the device body. At least one of the first or second magnetic elements may include at least one magnet and a layer of plastic material that is disposed over the at least one magnet. The layer of plastic material may be a rigid plastic material, and/or include polyurethane.

The coupler may include a piercing pin and a clasp, with the piercing pin having a piercing end and being configured to be inserted through a layer of the article of clothing for releasably coupling the second magnetic element to that article of clothing. The clasp is configured to retain the piercing end of the piercing pin when the second magnetic element is coupled to the article of clothing. The coupler may include a biasing element that is coupled to one end of the piercing pin, with the coupler having an open position in which the piercing end is away from the clasp and a closed position in which the piercing end is retained in the clasp. The biasing element in that embodiment urges the coupler toward the open position of the coupler. The biasing element, in specific embodiments, is in the form of a spring. The coupler may include one of a hook and loop fastener, a temporary adhesive, or a resilient clip that is configured to releasably couple the second magnetic element to the article of clothing.

In another embodiment, a firearm concealment system is configured for use by a person carrying a firearm on that person's body and who is wearing an article of clothing. The system includes a body-mounting device that is configured for securement to the body of the person, with that body-mounting device including a device body and a first magnetic element that is disposed on the device body. The system also includes a second magnetic element that is configured to cooperate with the first magnetic element to magnetically engage the first and second magnetic elements to one another. Magnetic engagement between the first and second magnetic elements is effective to secure a position of the article of clothing relative to the device body. The second magnetic element includes a coupler for releasably coupling the second magnetic element to the article of clothing.

In another embodiment, a weapon holster has a holster body that includes a plurality of walls defining a encasement for the weapon and an opening for inserting the weapon into that encasement. The walls include an interior wall, as well as an exterior wall disposed opposite the interior wall. The holster also includes a first magnetic element disposed on the holster body, and a second magnetic element that is configured to cooperate with the first magnetic element to magnetically engage the first and second magnetic elements with one another. The second magnetic element includes a coupler for coupling the second magnetic element to an article of clothing. The weapon may, for example, be firearm or a knife.

In yet another embodiment, a method is disclosed for concealing a firearm holster that is carried in a person's waist area or some other part of that person's body. The method comprises securing a first magnetic element to the holster, and releasably securing a second magnetic element to an article of clothing being worn by the person. The first and second magnetic elements are moved into proximity with one another and made to magnetically engage one another to thereby overlay a portion of the article of clothing against the holster, and thereby concealing the holster from view.

In another embodiment, a method is disclosed for concealing a weapon holster that is carried in a person's waist area or some other part of that person's body. The method comprises securing a first magnetic element to the holster, and releasably securing a second magnetic element to an article of clothing being worn by the person. The first and second magnetic elements are moved into proximity with one another and made to magnetically engage one another to thereby overlay a portion of the article of clothing against the holster, and thereby concealing the holster from view.

Yet in another embodiment, a firearm holster has a holster body that includes a plurality of walls defining an encasement for the firearm and an opening for inserting the firearm into that encasement. The walls include an interior wall, as well as an exterior wall disposed opposite the interior wall.

The holster also includes a first magnetic element disposed on the holster body, and a second magnetic element that is configured to cooperate with the first magnetic element to magnetically engage the first and second magnetic elements with one another. The first magnetic element includes a pair of magnets, each of which has a nominal magnetic pull force between about 19 Newtons and about 26 Newtons.

The second magnetic element is configured for coupling to an article of clothing and includes a ferrous metallic plate configured for magnetic engagement with the pair of magnets of the first magnetic element. The holster may additionally include a restraining feature at the interface between the first and second magnetic elements and configured to hinder sliding movement of the first and second magnetic elements relative to one another when the first and second magnetic elements are magnetically coupled. Additionally or alternatively, a layer of a rigid or flexible plastic material may be disposed over the ferrous metallic plate.

In another embodiment, a firearm concealment system is configured for use by a person carrying a firearm on that person's body. The system includes an article of clothing such as a shirt, for example, and a holster for carrying the firearm, or a body-mounting device that is configured for securement to the body of the person. The body-mounting device includes a device body and a first magnetic element that is disposed on the device body. The system also includes a second magnetic element disposed on or otherwise forming part of the article of clothing and configured to cooperate with the first magnetic element to magnetically engage the first and second magnetic elements to one another.

Magnetic engagement between the first and second magnetic elements in that embodiment is effective to secure a position of the article of clothing relative to the device body. The body-mounting device may, for example, be a waist-mounting device (e.g., a belt, a resilient clip securable to a conventional belt, a flexible strap). Alternatively, the body-mounting device may for example and without limitation take the form of a holster-carrying vest or a flexible strap configured to be worn on a person's torso or other body part.

BRIEF DESCRIPTION OF THE DRAWINGS

The objectives and features of the invention will become more readily apparent from the following detailed description taken in conjunction with the accompanying drawings in which.

DETAILED DESCRIPTION OF PARTICULAR EMBODIMENTS

To the extent that any meaning or definition of a term in this written document conflicts with any meaning or definition of the term in a document incorporated by reference, the meaning or definition assigned to the term in this written document shall govern. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Further, "connected" and "coupled" are not restricted to physical or mechanical connections or couplings. Also, as used herein, the term "releasable coupling," "releasable attachment," and related terms refer to a type of coupling/attachment in which the coupled/attached structures may be readily detached, decoupled, or otherwise separated from one another in a simple manner and without causing the destruction or damage of any of those structures.

For the sake of further explanation, a permanent—rather than a "releasable"—type of coupling/attachment may refer, for example, to two structures that are integrally formed with one another, or which are adhesively attached with some type of non-releasable adhesive, such that their separation would necessarily result in at least some level of damage to one or more of the parts being separated from one another. For ease of explanation, and unless otherwise stated, identical numerals throughout this description and figures refer to similar features in the various embodiments herein described, with the structure and functionality of those features as described with respect to a particular embodiment being similarly applicable to the identically-numbered features in other embodiments. It should also be noted that similar features in various embodiments may be identified by different numerals to facilitate understanding of the embodiment being described, notwithstanding their similarity in structure and/or functionality.

Figure 1:
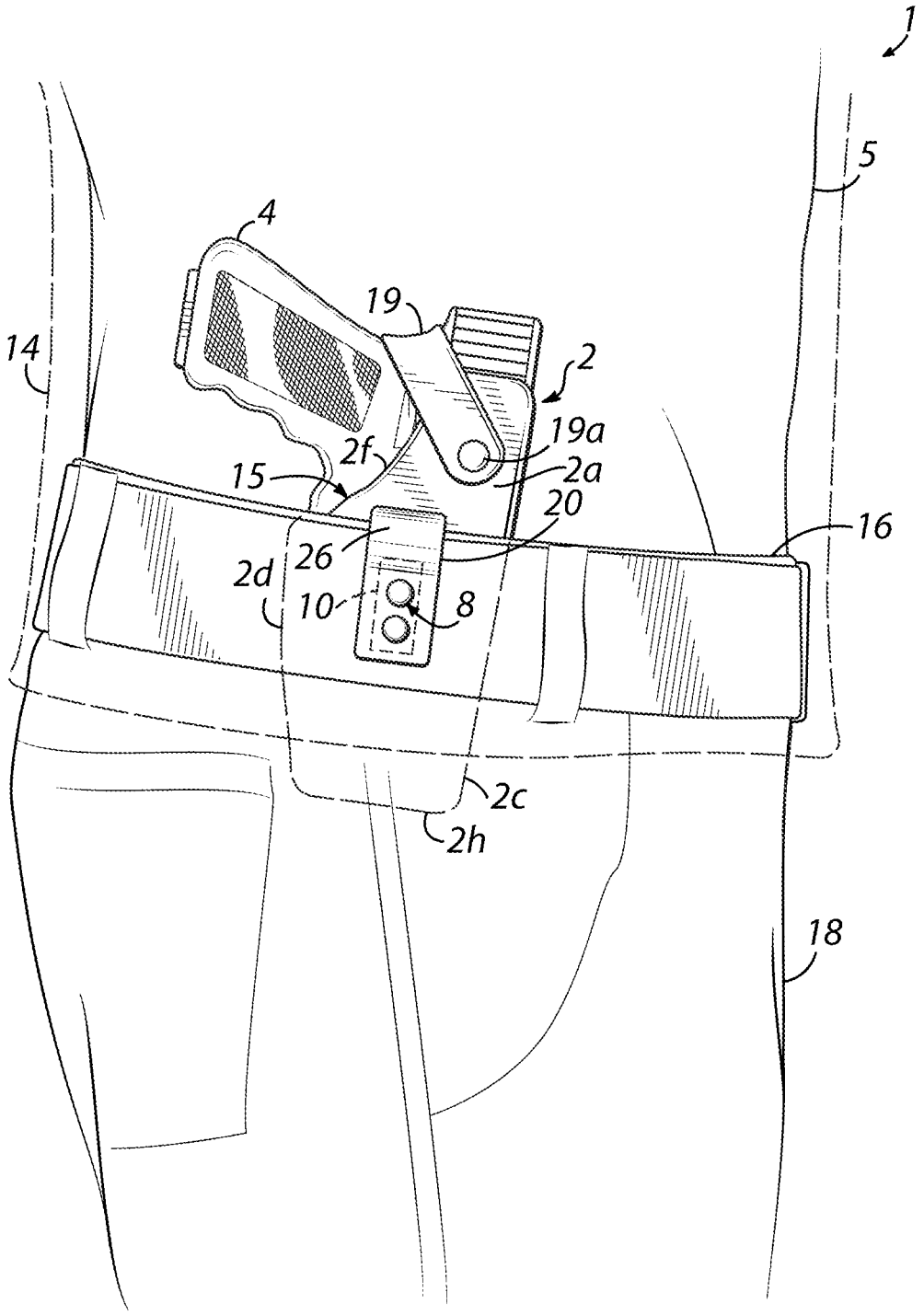
FIG. 1 is an elevation front view of a firearm and/or holster concealment system in accordance with one embodiment of the invention.
Figure 2:
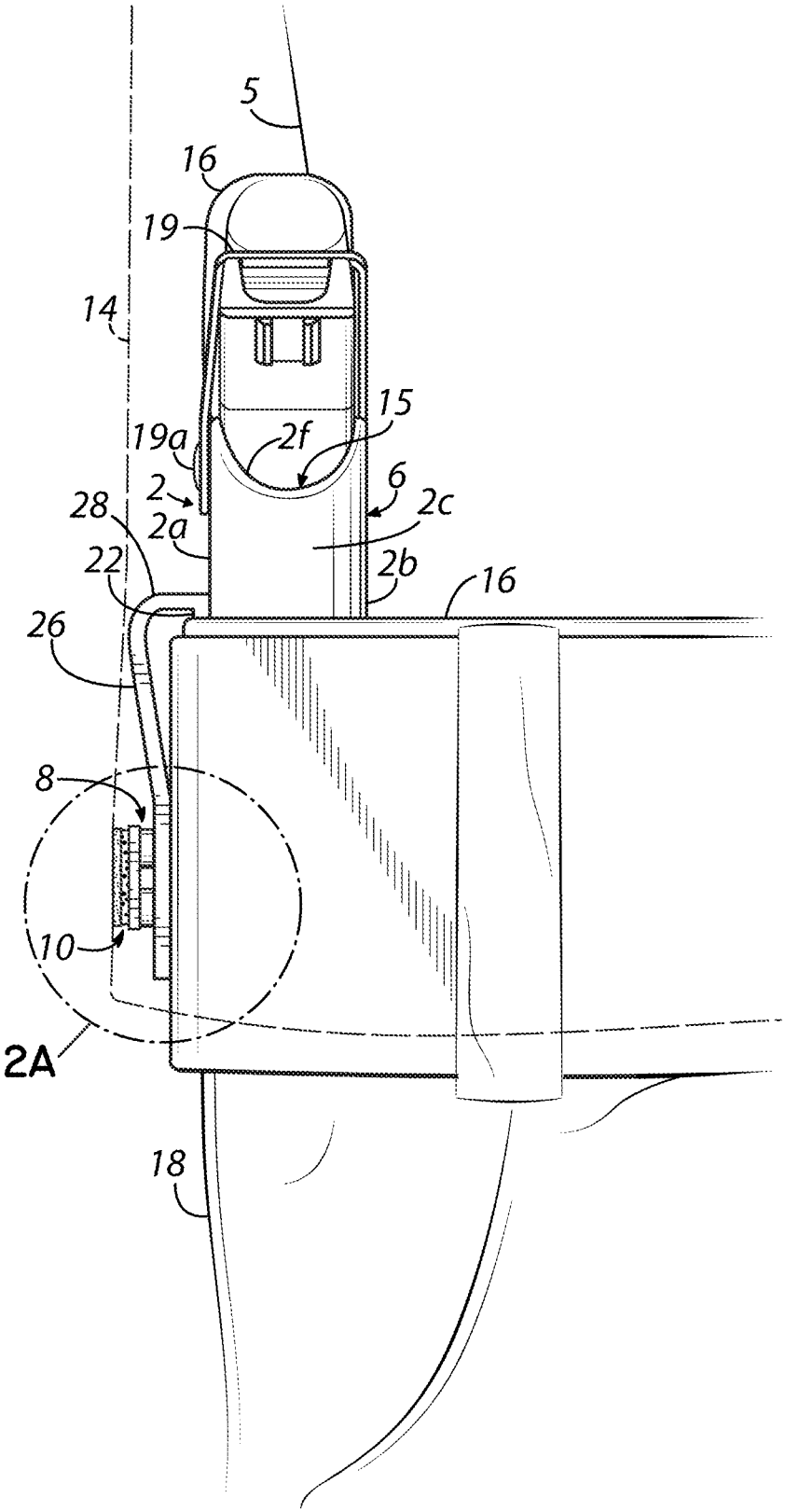
FIG. 2 is an elevation side view of the system of FIG. 1.

With reference to the figures, and particularly to FIGS. 1 and 2, a firearm concealment system 1 is shown that permits a person carrying a firearm holster 2—with or without a firearm 4 in it—on that person's body 5, in order to hide that holster 2 and/or firearm 4 from view from other persons. System 1 includes first and second magnetic elements 8, 10 that cooperate with one another to magnetically secure at least a portion of an article of clothing 14, such as the tail portion of a shirt, being worn by the person, to the holster 2.

Holster 2 of the embodiment shown in FIGS. 1 and 2 is an inside-the-waistband type holster that is designed to be worn as suggested by those figures, namely, immediately adjacent the waist area of the person's body 5 and interiorly of the waistband 16 (or similar feature) of a pair of pants 18 worn by that person. It is contemplated, however, that the principles and features described throughout this disclosure are similarly applicable to other types of holsters, even if not shown. Such holsters may include, for example and without limitation, holsters designed to be worn exteriorly of the waistband 16 and therefore hang on the outside of pants 18, holsters designed to be supported inside a pocket of the pants 18, holsters designed to be supported adjacent the torso of body 5 (e.g., below the armpit), as well as holsters intended to be worn in the ankle area of body 5. For ease of explanation, the description herein will refer to the illustrative embodiment in the figures.

The example holster 2 in FIGS. 1 and 2 includes an exterior wall 2*a* configured to face away from body 5, and an interior wall 2*b* configured to face inwardly i.e., toward body 5 of the person. Walls 2*a*, 2*b* jointly define a holster body 6 of holster 2 and are joined to one another along seams or front and back wall portions 2*c*, 2*d* to define an encasement sized and shaped to support firearm 4 in an interior 15 of holster 2. Walls 2*a*, 2*b* also define an opening 2*f* that provides access to the interior 15 of holster 2, as well as a bottom seam or bottom wall portion 2*h* disposed opposite opening 2*f* and which is configured to further support firearm 4 in interior 15 and face and/or support the muzzle of the firearm 4. The holster 2 in the illustrated embodiment further includes a strap 19 having a snap-type fastener 19*a* that secures the firearm 4 in place in interior 15, thereby preventing the firearm 4 from inadvertently separating from and falling out of holster 2. Body 6 of holster 2 also includes a belt clip 20 having a pair of oppositely-disposed interior and exterior walls or plates 22, 26 that are inwardly urged i.e., toward one another, by virtue of a hinge 28 connecting those plates 22, 26.

The first magnetic element 8 of system 1 is configured to be releasably or permanently attached to a suitably chosen part of body 6 of holster 2, or may even be integrally formed with that holster body 6. An example of first magnetic element 8 being integrally formed with holster body 6 includes the holster body 6 being made of an injection-molded plastic material, and at least a plastic material portion of first magnetic element 8 being formed as part of the same injection molding process through which holster body 6 is manufactured. An example of first magnetic element 8 being releasably attached to holster body 6 includes—without limitation—first magnetic element 8 being attached to holster body 6 through a male and female hook-and-loop fastener, a snap-type male-female fastener, a releasable pressure-sensitive adhesive or some other kind of releasable adhesive, a strap, an elasticized band, a magnet, or a screw. In the illustrated embodiment, and by way of example only, the first magnetic element 8 is integrally formed with or permanently attached to the belt clip 20 of holster 2, although it is contemplated that first magnetic element 8 may instead be releasably attached to the belt clip 20 or be releasably attached to, permanently attached to, or even integrally formed with another part of body 6 instead, such as exterior wall 2*a* of holster body 6, for example, or even to strap 19.

Figure 2A:
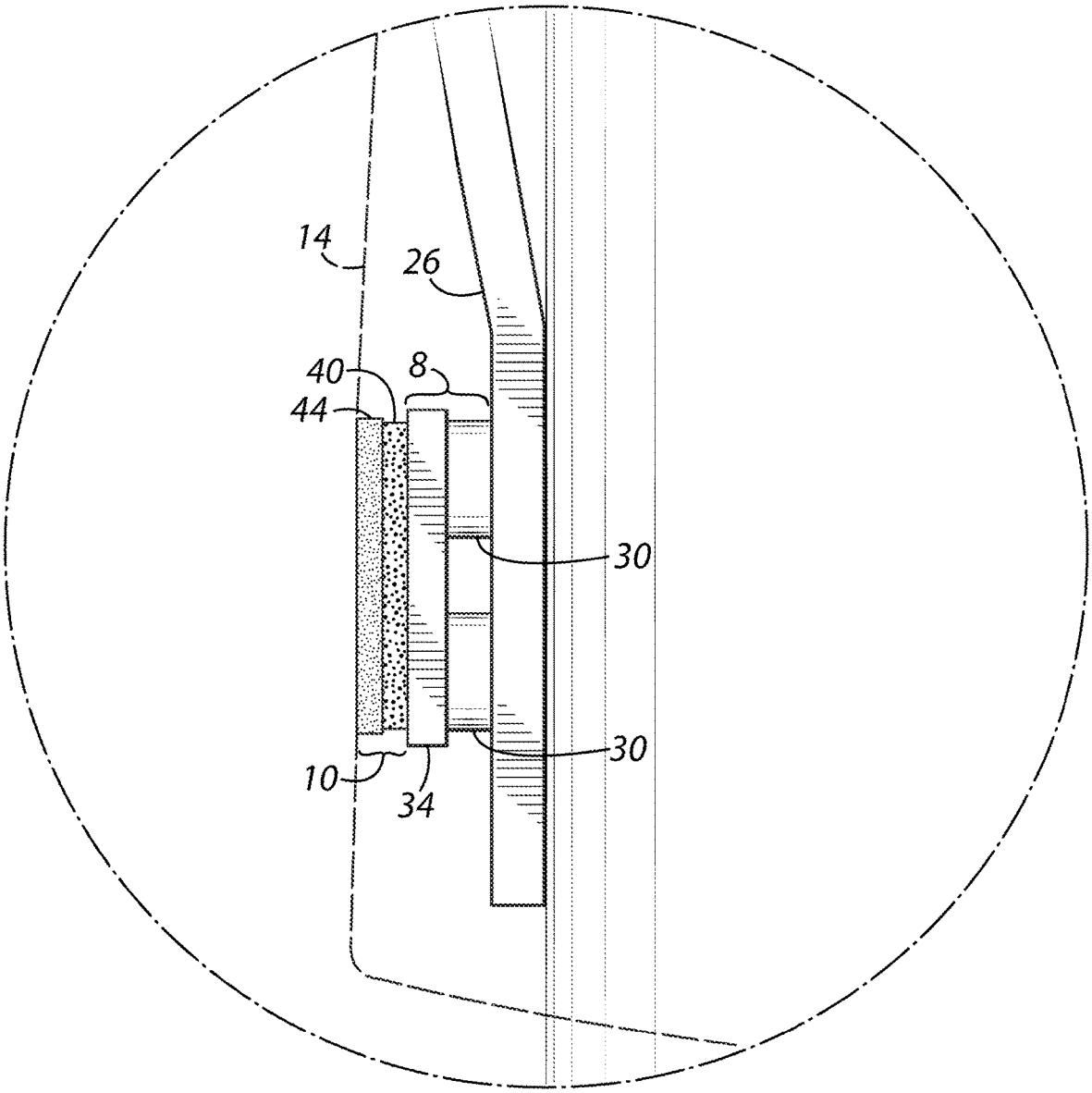
FIG. 2A is an enlarged view of the encircled area 2A in FIG. 2.

With continued reference to FIGS. 1 and 2, and referring further to FIG. 2A, the first magnetic element 8 in the illustrated embodiment includes one or more magnets 30, which may be made of neodymium (NdFeB), for example, or from some other magnetic material. While not shown, first magnetic element 8 may include a base plate made out of metal, plastic, or some other suitably chosen material capable of supporting the one or more magnets 30. A layer 34 of a rigid plastic material, a flexible plastic material such as polyurethane, or a natural or synthetic rubber material is disposed over magnets 30 and provides the exterior of first magnetic element 8 with a smooth surface that prevents inadvertent entanglement of magnets 30 with exterior objects with which first magnetic element 8 may come in contact and which may otherwise cause detachment of those magnets 30 from first magnetic element 8.

Notably, the presence of layer 34 disposed over magnets 30 lowers the total magnetic effective pull force of first magnetic element 8 relative to an embodiment using no coating of any sort over the magnets 30. The presence of layer 34, accordingly, may require the use of more powerful and expensive magnets 30 than would be otherwise necessary. Further, the presence of layer 34 may lead to a first magnetic element 8 that is bulkier than would otherwise be necessary. In embodiments in which first magnetic element 8 has a base plate as described above, layer 34 may be secured to that base plate as well in order to further secure the one or more magnets 30.

In an alternative embodiment, not illustrated in the figures, the first magnetic element is instead releasably attached to the belt clip 20 (or to another part of body 6 of holster 2, such as exterior wall 2*a* or strap 19). To that end, a coupling component in the form of a hook-and-loop fastener, a releasable/temporary adhesive, a clamp, or some other type of coupling component may be present and configured to permit selective releasable attachment and detachment of first magnetic element 8 to/from belt clip 20. In that embodiment, the one or more magnets 30 may be attached to a plastic or metallic plate and may further include a layer such as the layer 34 described above. In that alternative embodiment, the back side of the plastic or metallic plate would interact with the coupling component in order to temporarily (and releasably) secure the first magnetic element 8 to the body 6 of holster 2.

Figure 3:
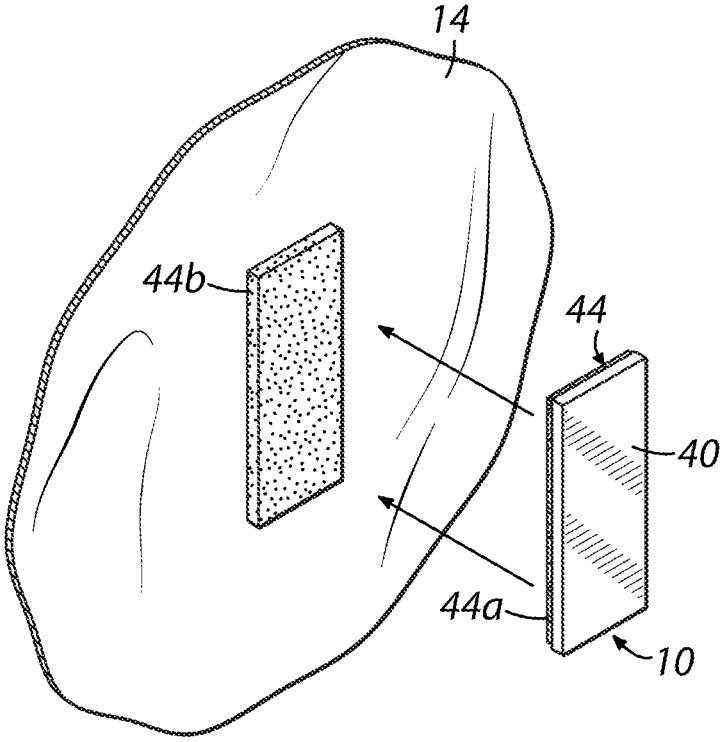
FIG. 3 is a perspective view of a second magnetic element of the system of FIGS. 1 and 2 in accordance with one embodiment of the invention.

With continued reference to FIGS. 1, 2, and 2A, and further referring to FIG. 3, the second magnetic element 10 is configured for permanent or releasable attachment to the article of clothing 14 (e.g., the tail portion of a shirt) worn by the person, and is configured to cooperate with the first magnetic element 8. The second magnetic element 10, to that end, includes a thin ferrous metallic plate 40 that is configured to be magnetically attracted to (and engaged with) the one or more magnets 30 of first magnetic element 8, to thereby secure a position of at least a portion of the article of clothing 14 relative to the part of the holster body 6 that has the first magnetic element 8 thereon.

The ferrous metallic plate 40 may be a solid plate or may be, in particular embodiments, a flexible ferrous metallic mesh, the flexibility of which may be desirable to conform with the flexibility of the article of clothing 14. In alternative embodiments, the second magnetic element 10 includes one or more magnets similar to or different from the one or more magnets 30 described above, but oriented such that the polarity of those one or more magnets is/are the opposite of the polarity of the one or more magnets 30 of the first magnetic element 8, such that the magnets of the two magnetic elements attract rather than repel one another.

In embodiments in which a magnet is used to releasably attach first magnetic element 8 to any part of holster body 6 (or to some other component worn by the wearer adjacent holster 2), the total effective pull force of that magnet may be higher (e.g., between about 25% and about 300% higher) than the total effective pull force between the first and second magnetic elements 8, 10, such that separation between elements 8, 10 by the wearer, when desired, does not inadvertently result in first magnetic element 8 detaching from the holster body 6 (or from any other structure/component carrying to which first magnetic element 8 is designed to be attached.

With particular reference to FIG. 3, the second magnetic element 10 in the illustrated embodiment includes a coupler 44, schematically depicted in that figure, that permits second magnetic element 10 to be releasably attached to the article of clothing 14. Notably, the releasable nature of the coupling of second magnetic element 10 with article of clothing 14 facilitated by coupler 44 allows second magnetic element 10 to be conveniently removed from one article of clothing and reattached, releasably, to another article of clothing.

Figure 4:
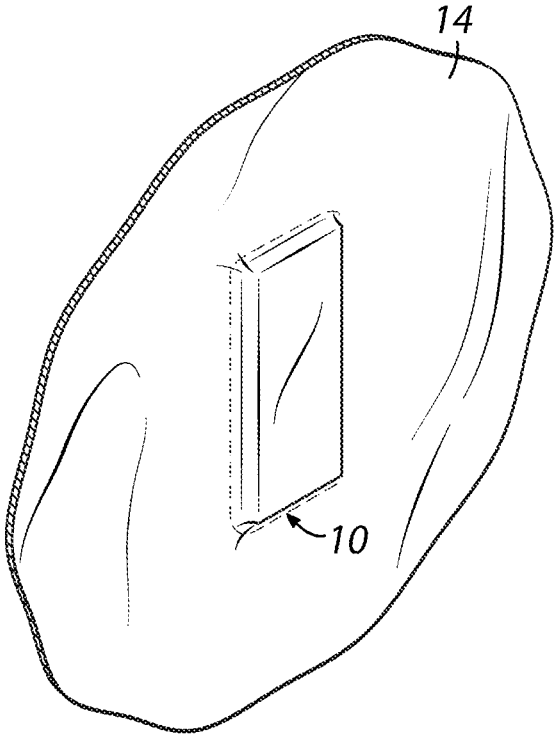
FIG. 4 is a perspective view of a second magnetic element in accordance with an alternative embodiment of the invention.

With reference to FIG. 4, an embodiment is shown of a second magnetic element 10 that has no coupler 44 at all, or at least not a coupler that facilitates releasable coupling of that magnetic element 10 with an article of clothing 14. In that embodiment, the second magnetic element 10 is instead configured to be permanently attached to (e.g., sewn into) an article of clothing 14. In the exemplifying embodiment illustrated in the figure, second magnetic element 10 has been sewn into article of clothing 14 so as to be located between layers of that article of clothing 14. A variation of that embodiment includes the second magnetic element 10 being sewn or otherwise releasably of permanently attached to the surface or layer of the article of clothing 14 adjacent the body 5 of the person, or even interiorly disposed between two layers of the material making up article of clothing 14. While not shown, the second magnetic element 10 in FIG. 4 may include one or more magnets and, additionally or alternatively include a layer of rigid or flexible plastic material similar to layer 34 described above in connection with other embodiments.

Referring again to FIG. 3, coupler 44 may take one of various forms. For example, it may be in the form of a hook-and-loop fastener having a first hook-and-loop component 44*a* (e.g., a hook substrate) disposed on the second magnetic element 10 and a cooperating second hook-and-loop component (e.g., a loop substrate) 44*b* disposed—releasably or permanently—on article of clothing 14. It is contemplated, in that regard, that the second magnetic element 10 may include several of the second hook-and-loop components 44*b* that may be selectively permanently secured to various articles of clothing 14 owned by the person.

Alternatively, second magnetic element 10 may include one of a male or female component of a snap fastener, while article of clothing 14 may include the other cooperating male or female component of that snap fastener, and there may be several shirts (or other articles of clothing) owned by the person, each of which has one of the two snap fastener parts already permanently secured to the shirt and ready to cooperate with the other snap fastener part forming part of second magnetic element 10. While not shown, the second magnetic element 10 in FIG. 3 may include one or more magnets and, additionally or alternatively include a layer of rigid or flexible plastic material similar to layer 34 described above in connection with other embodiments.

For such contemplated embodiment having several second hook-and-loop components 44*b* or male/female snap fastener parts, when a person (i.e., a carrier of a firearm) substitutes one article of clothing, such as a shirt, for another, the new/clean article of clothing 14 would already have one of the second hook-and-loop components 44*b* or snap fastener parts pre-installed and ready to cooperate with the first hook-and-loop components 44*a* (or other cooperating male/female snap fastener part) of coupler 44. Alternatively, coupler 44 may take the form of or otherwise include a temporary adhesive that is configured to releasably adhere to cloth or other materials from which articles of clothing, are typically made, or include a clamp, clip, snap fastener, or similar device capable of securing second magnetic element 10 to the article of clothing 14. Yet in other embodiments, coupler 44 may take the form of holes through the second magnetic element 10 and which allow a needle and thread to be inserted through them for sewing the second magnetic element 10 to the article of clothing 14.

Figure 5:
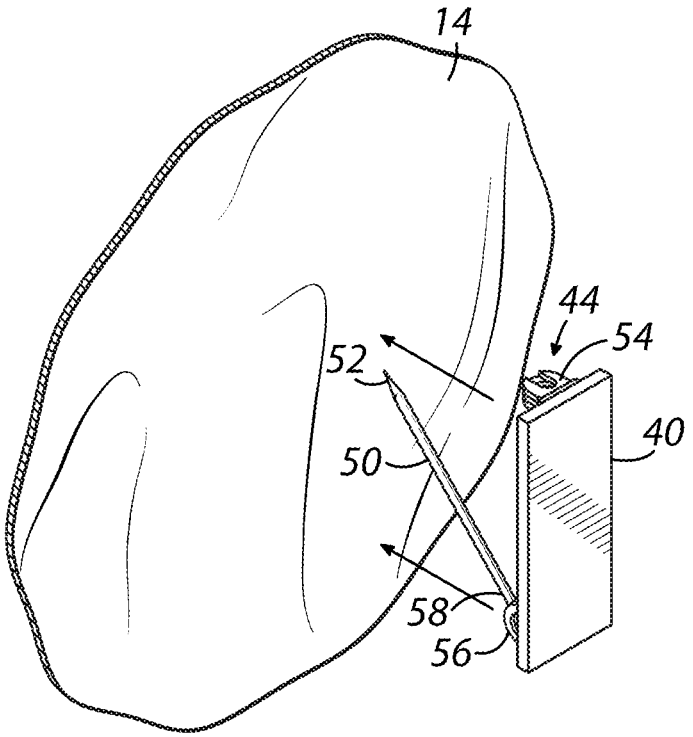
FIG. 5 is a perspective view of a second magnetic element in accordance with yet another alternative embodiment of the invention.

Referring now to FIG. 5, the embodiment illustrated in that figure has a coupler 44*k* that includes an elongate piercing pin 50 having a piercing end 52 configured to be inserted through one or more layers of article of clothing 14 to thereby releasably attach second magnetic element 10 to that article of clothing 14. In operation, the piercing pin 50 may be inserted twice through one or more layers of article of clothing 14, and the piercing end 52 then retained in place in a clasp 54 of the coupler 44*k*. In the illustrated embodiment, coupler 44*k* also includes a biasing element in the form of a spring 56 at a base or proximal end 58 of the piercing pin 50.

Spring 56 urges piercing pin 50 toward an open position of that coupler 44*k* in which piercing end 52 of piercing pin 50 is away from clasp 54, which facilitates the process of insertion of piercing pin 50 into the one or more layers of clothing 14. That urging exerted by spring 56 also frictionally pins piercing end 52 against the retaining interior surfaces of clasp 54, thereby securing piercing end 52 within clasp 54 and defining a closed position of coupler 44*k*. While not shown, the second magnetic element 10 in FIG. 5 may include one or more magnets and, additionally or alternatively include a layer of rigid or flexible plastic material similar to layer 34 described above in connection with other embodiments.

Figure 6:
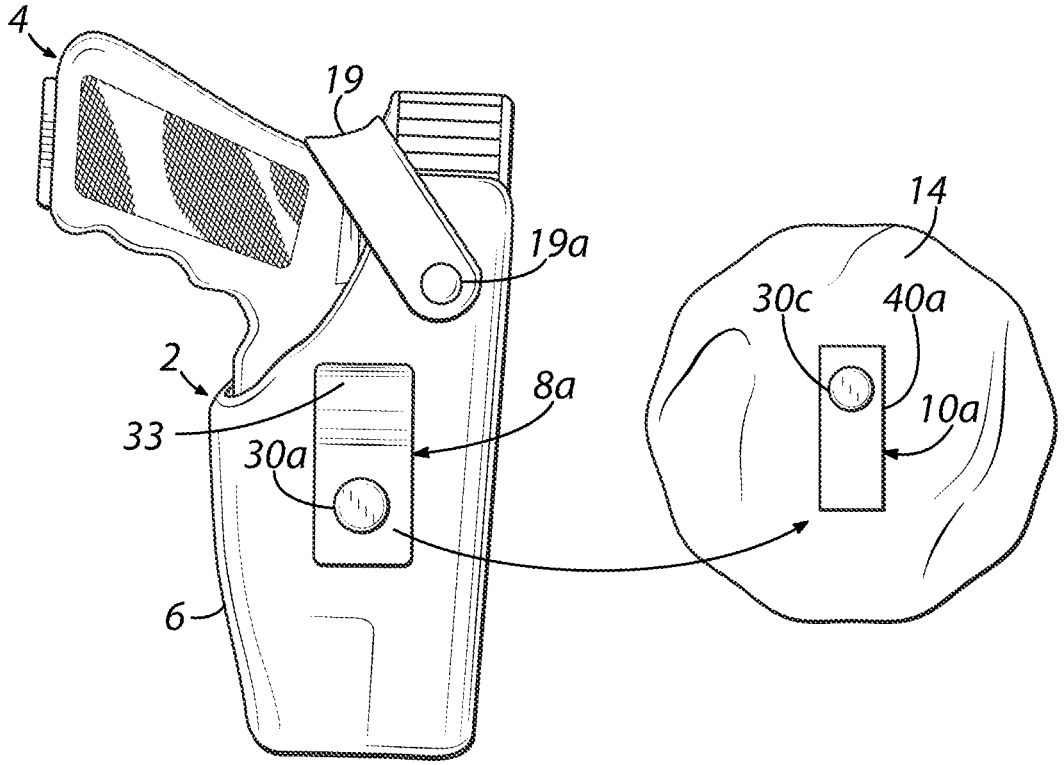
FIG. 6 is an elevation front view of a firearm and/or holster concealment system in accordance with an alternative embodiment of the invention.

With reference to FIG. 6, an alternative embodiment includes a first magnetic element 8*a* that has a single magnet 30*a* and which also includes a ferrous metallic plate 33. In that embodiment, a second magnetic element 10*a* is configured to cooperate magnetically with the first magnetic element 8*a* and includes, to that end, a single magnet 30*c* having a polarity that is the same as that of magnet 30*a*, as well as a ferrous metallic plate 40*a*. As the two magnetic elements 8*a*, 10*a* approach one another, each of the magnets 30*a*, 30*c* is respectively attracted to and ultimately magnetically engages (i.e., couples) with the opposing ferrous metallic plate 40*a*, 33, thereby resulting in the first and second magnetic elements 8*a*, 10*a* being releasably coupled to one another, and securing a portion of the article of clothing 14 in position relative to holster 2.

It is contemplated that the first magnetic element (i.e., the magnetic element disposed on the holster 2), in alternative embodiments, may be free of magnets, and instead have a ferrous metallic plate—similar to ferrous plate 33 of the embodiment described above, configured to be magnetically attracted to and engageable with one or more magnets in the cooperating second magnetic element 10 (i.e., the magnetic element disposed on the article of clothing). In those contemplated embodiments, the metallic plate of the first magnetic element may include a layer of a rigid or flexible plastic material, similar to layer 34 in the embodiment illustrated in FIGS. 2 and 2A, for example.

The number and type of magnets 30, 30*a*, 30*c* as well as the thickness and type of material making up layer 34, if present, in the first and/or second magnetic elements, are suitably chosen such that the total effective pull force of the first or second magnetic element 8, 8*a*, 10, 10*a* in some embodiments, does not exceed about 11 Newtons, or so that it is less than about 11 Newtons, such as being less than about 9 Newtons. For example, the total effective pull force may be in the range of about 4 Newtons to about 9 Newtons, be less than about 7 Newtons, less than about 4 Newtons, or even less than about 2 Newtons. Each of the above-identified ranges has particular advantages and disadvantages. For example, a total effective pull force above about 11 Newtons or even above about 9 Newtons may be too strong for the intended purpose and lead to the firearm (or other type of weapon) inadvertently sticking to the first or second magnetic elements 8, 8*a*, 10, 10*a* during insertion and/or removal of the firearm into the interior 15 of holster 2.

A low total effective pull force of e.g., less than about 2 Newtons or even less than about 4 Newtons, conversely, may be too weak for the intended purpose and not provide enough magnetic attraction to secure the first and second magnetic elements 8, 8*a*, 10, 10*a* to one another. It should be noted that the acceptable range of total effective magnetic pull force may also depend on whether the second magnetic element is configured for coupling with an underside of the article of clothing 14 (i.e., the surface facing away from the wearer's waist), in which case magnetic coupling between the first and second magnetic elements 8, 8*a*, 10, 10*a* is indirect i.e., it includes the material making up article of clothing 14 between the two magnetic elements. In embodiments for which the second magnetic element is configured instead for coupling to the surface of the article of clothing 14 facing the waist of the wearer, the acceptable range of total effective magnetic pull force may be different.

The specific nominal magnetic pull force of a magnet selected for one or both of the first or second magnetic elements 8, 8*a*, 10, 10*a* depends on various factors that may lower the total effective pull force of the magnetic element. For example, and without limitation, a magnet may have a layer of plastic, polyurethane, or some other material (such as layer 34 in the embodiment of FIGS. 1, 2, and 2A) disposed over it, and the thickness and/or materials making up that layer will lower the magnet's effective pull force to various degrees. Similarly, a layer of plastic, polyurethane, or some other material may additionally or alternatively be disposed over a ferrous metallic plate forming part of the first or second magnetic element, which would also lower the strength of the magnetic attraction between the magnet being used to magnetically couple the first and second magnetic elements to one another in that type of construction.

Specific embodiments include a first magnetic element 8 attached to the body of a holster and having two neodymium magnets each rated for a nominal pull force in the range between about 19 Newtons and about 26 Newtons, without any layer of material (such as the layer 34 described above) over the two magnets, for a resulting total effective magnetic pull force in the range between about 38 Newtons and about 52 Newtons. As used herein, the term "nominal" in connection with a pull force refers to the pull force that is identified or otherwise provided for a commercially available magnet, and typically provided in units of pound-force or Newtons as a measure. The nominal pull force is typically measured in a laboratory by measuring the maximum (i.e., peak) value of the pull force generated when separating a magnet being tested from a flat steel plate having an uncoated, even surface; taking that measurement five times (i.e., five samples), and calculating the average value for the five measurements. The measurement of pull force is taken with a digital force gauge that measures the tensile force required to separate the magnet being tested from the steel plate, which records the peak value reached during separation of the magnet and flat steel plate from one another.

The total effective magnetic pull force for a magnetic element having one or more magnets and other components (e.g., a plastic layer thereon) is measured/calculated in similar fashion, by substituting the magnetic element for the magnet in the test described above i.e., measuring the peak force when separating that magnetic element from a flat steel plate having an uncoated, even surface. The total effective magnetic pull force between two magnetic elements each having at least one magnet, for purposes of the present description, is the sum of the measured effective pull force values for each of the two magnetic elements.

In one such specific embodiment tested by the inventor, a concealment system included a first magnetic element using two such neodymium magnets, and a second magnetic element made up of a ferrous metallic plate coated with a layer of synthetic rubber into which the metallic plate was first dipped to result in a solid rubberized layer having a thickness between about 0.2 mm and about 0.5 mm, and more specifically about 0.3 mm. The rubberized coating used in that tested embodiment is known under the trade name PLASTI DIP®, available from Plasti Dip International of Blaine, Minnesota, United States of America. In that specific embodiment, each of the two neodymium magnets used for the first magnetic element had a nominal pull force of 22.5 Newtons. That specific embodiment provided the right balance between the magnetic force required to effectively keep the first and second magnetic elements coupled to one another during use, and a level of magnetic force that allowed the user to disengage the two magnetic elements from one another with relative ease.

Further, that specific embodiment resulted in a magnetic force of the first magnetic element that did not cause inadvertent magnetic engagement with a firearm when same was inserted into or removed from a holster. Other example systems were tested similar to the one described above, but with magnets having a nominal pull force as low as about 19 Newtons and as high as about 26 Newtons. It was observed that—for certain exemplifying embodiments of concealment systems using two magnets each having a nominal pull force lower than about 19 Newtons, the two magnetic elements would become disengaged with relative ease during use, especially in concealment systems in which a layer of the article of clothing worn by the firearm carrier ended up at the interface between the first and second magnetic elements. Similarly, example systems using magnets each having a nominal pull force higher than about 26 Newtons resulted in the two magnetic elements being too difficult to separate without undue force.

Figure 7:
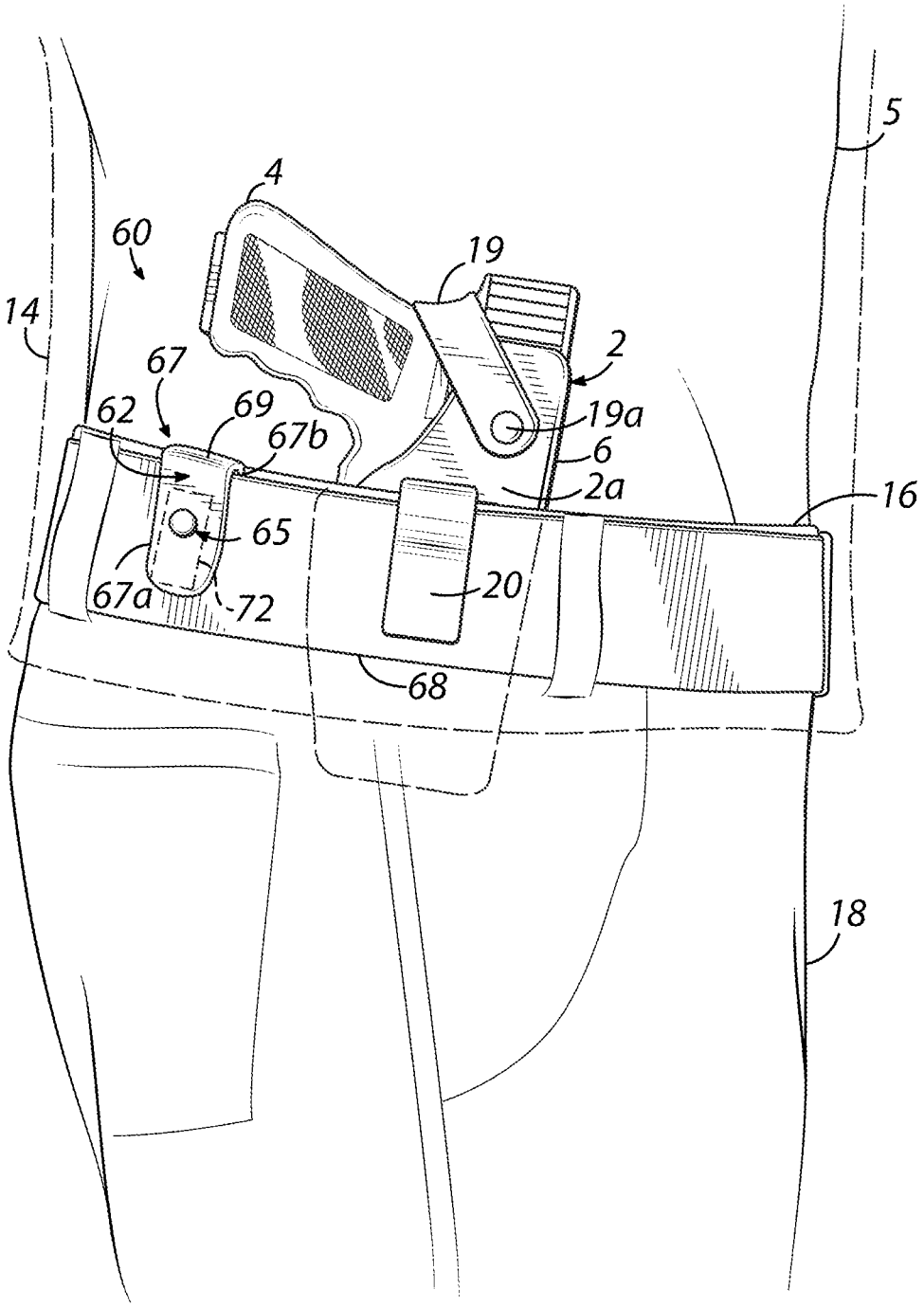
FIG. 7 is a view similar to FIG. 1, illustrating yet another alternative embodiment of the invention.
Figure 8:
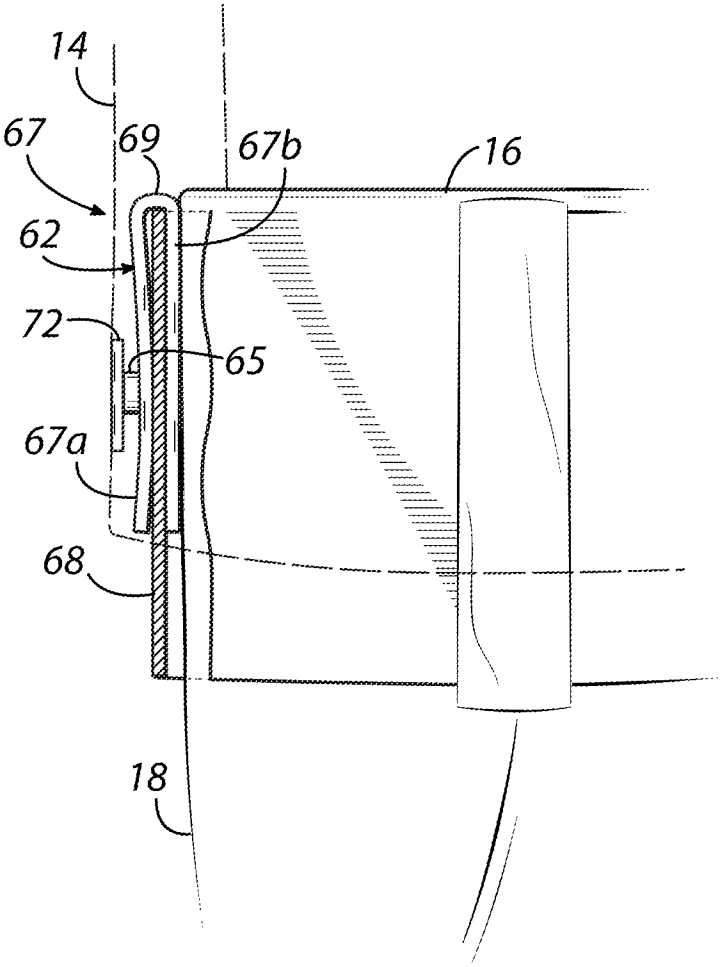
FIG. 8 is an elevation side view of a portion of a firearm and/or holster concealment system in accordance with an alternative embodiment of the invention.

With reference to FIGS. 7 and 8, another exemplifying embodiment is illustrated of a firearm concealment system 60 that includes a waist mounting device configured to be secured to the waist area of the person, and which includes a device body 62 and a first magnetic element 65 disposed on that device body 62. In the illustrated embodiment, the waist mounting device is in the form of a resilient belt clip 67—defining the body 62 of that device, and configured to be secured to and over a conventional belt 68 worn by the person. To that end, resilient belt clip 67 includes oppositely disposed exterior and interior walls or plates 67*a*, 67*b*, pivotally connected at their proximal ends by a hinge 69 that urges plates 67*a*, 67*b* inwardly, toward one another, when pulled apart. The exterior and interior plates 67*a*, 67*b* are configured to respectively lie against the exterior and interior surfaces of the conventional belt 68.

First magnetic element 65 is disposed on the exterior surface of exterior plate 67*a* and may be permanently or releasably attached to that exterior plate 67*a*. First magnetic element 65 may take any of the forms described above in connection with the embodiments associated with the preceding figures, and their contemplated variations, and thus may be similar in structure and functionality to either of the first magnetic elements 8, 8*a* described above, for example. First magnetic element 65 magnetically cooperates with a second magnetic element 72 forming part of firearm concealment system 60, to secure at least a portion of an article of clothing 14—to which second magnetic element 72 is releasably or permanently coupled—relative to device body 62.

In use, the resilient belt clip 67 is mounted over and secured to the belt 68 worn by the person in that person's general waist area and somewhat adjacent the location of a holster 2 or the location of the firearm 4 even if carried inside the pocket (with a portion of the firearm protruding out of the pocket and therefore exposed, for example). The attraction of the two magnetic elements 65, 72 is effective to magnetically engage and therefore couple those two elements together, thereby securing a portion of the article of clothing 14 relative to resilient belt clip 67. The proximity of resilient belt clip 67 to the holster 2 and/or firearm 4 is effective to conceal the holster and/or firearm from view.

Figure 9:
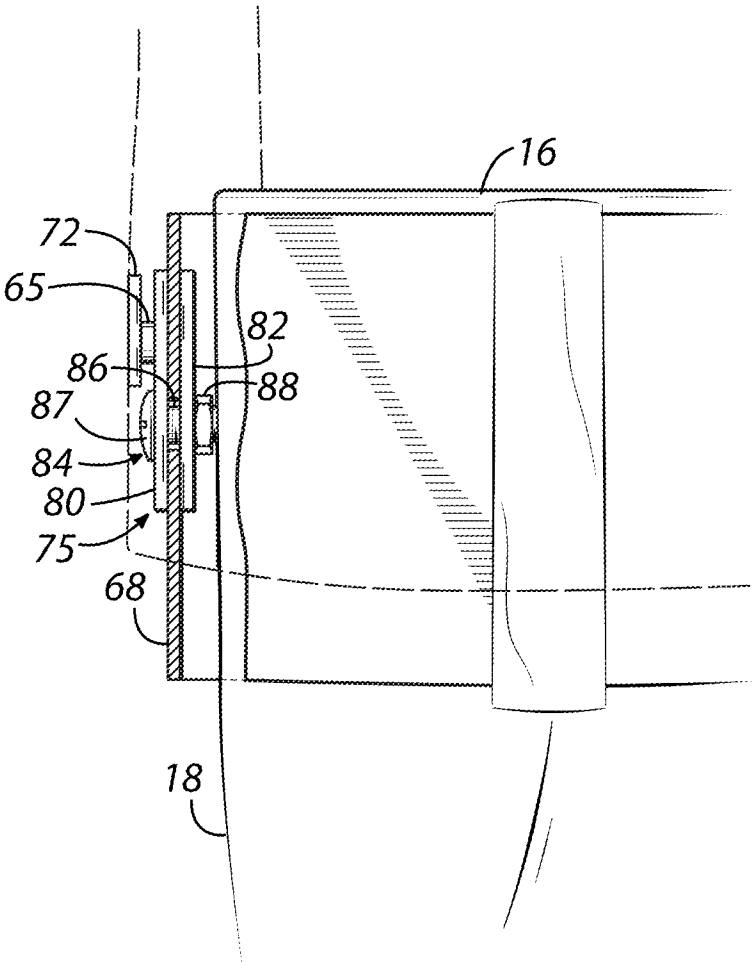
FIG. 9 is a view similar to FIG. 8 illustrating another embodiment of the invention.

FIG. 9 illustrates an exemplifying embodiment similar to that of FIGS. 7 and 8, but in which the waist mounting device has a device body 75 made up of first and second plates 80, 82 configured to lie respectively against the exterior and interior surfaces of belt 68, and a connector 84 configured to secure those two plates 80, 82 relative to one another and relative to the belt 68, In that embodiment, the connector 84 has the form of a bolt or screw having a threaded elongate member or shank 86 that extends through a conventional hole of a belt and two end stoppers in the form of a head 87 and nut 88 at respective ends of shank 86. Once shank 86 inserted through the hole of the belt 68 and through respective holes in each of the first and second plates 80, 82, the nut 88 is threadedly secured onto shank 86 such that the plates 80, 82 are urged toward one another and against the respectively confronting surfaces of belt 68. The waist mounting device in the illustrated embodiment includes a first magnetic element disposed on the device body 75 and which may be similar in structure and/or functionality to any of the first magnetic elements 8, 8*a*, 65 described above.

For ease of understanding, the first magnetic element 65 in the embodiments of FIGS. 7, 8, and 9 is shown as having nothing more than a single magnet, although it is understood that same could alternatively be free of magnets (e.g., be in the form of a ferrous metallic plate instead) or have a number of magnets in excess of one, and further may include other features such as a layer 34 of plastic material similar to that of the preceding embodiments.

While not shown, other contemplated embodiments include a waist mounting device that includes a device body in the form of a flexible strap or belt worn by the person in addition to or instead of the conventional belt 68 worn by that person to support his/her pants 18 relative to that person's waist. The waist mounting device in those contemplated embodiments includes a first magnetic element disposed on the device body and which may be similar in structure and/or functionality to any of the first magnetic elements 8, 8*a*, 65 described above, the description of which may be referred to for an understanding of these alternative embodiments as well. A shirt or other article of clothing 14 may include a second magnetic element that cooperates with the first magnetic element such that magnetic engagement between those two magnetic elements is effective to secure the position of at least a portion of that article of clothing 14 relative to the device body of the waist mounting device in those contemplated embodiments.

Yet other contemplated embodiments may include a body-mounting device in the form of a holster-carrying vest or even a flexible strap configured to be worn on a person's torso (e.g., below the armpit) or even a different part of that person's body (e.g., a leg or an arm), as well as a device body similar to either of the device bodies described above in connection with the embodiments of FIGS. 7-9, for example, and contemplated variations. In those contemplated embodiments, a first magnetic element is disposed on the device body of the body-mounting device, with that first magnetic element being similar in structure and/or functionality to any of the first magnetic elements 8, 8*a*, 65 described above in connection with other embodiments, the description of which may be referred to for an understanding of these alternative embodiments as well. A shirt or other article of clothing 14 may include a second magnetic element that cooperates with the first magnetic element such that magnetic engagement between those two magnetic elements is effective to secure the position of at least a portion of that article of clothing 14 relative the device body of the body-mounting device.

FIGS. 10, 10A, 10B, 11, 11A, 11B, 12, 12A, and 12B illustrate various embodiments of a concealment system that include a restraining feature at the interface of the first and second magnetic elements, configured to prevent or at least hinder sliding movement or slippage of the first and second magnetic elements relative to one another when magnetically coupled. For ease of understanding, FIGS. 10, 10A, 10B, 11, HA, 11B, 12, 12A, and 12B only show that portion of the concealment system that includes the restraining feature, and it is contemplated that the structure, components, and/or functionality in those example restraining features may be combined with any of the other embodiments described throughout this document and may therefore be used in combination with any other features in such other embodiments. Like reference numerals in FIGS. 10, 10A, 10B, 11, 11A, 11B, 12, 12A, and 12B refer to similar features in the embodiments associated with other figures of this document, the description of which may be referred to for an understanding of those features in these figures as well.

Figure 10:
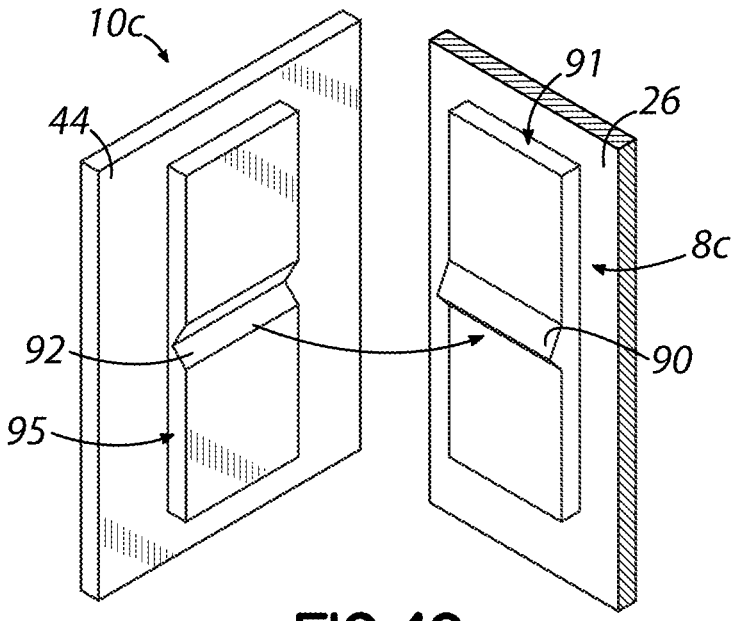
FIG. 10 is a perspective view of a pair of magnetic elements configured for magnetic and mechanical coupling with one another, in accordance with one embodiment of the invention.
Figure 10A:
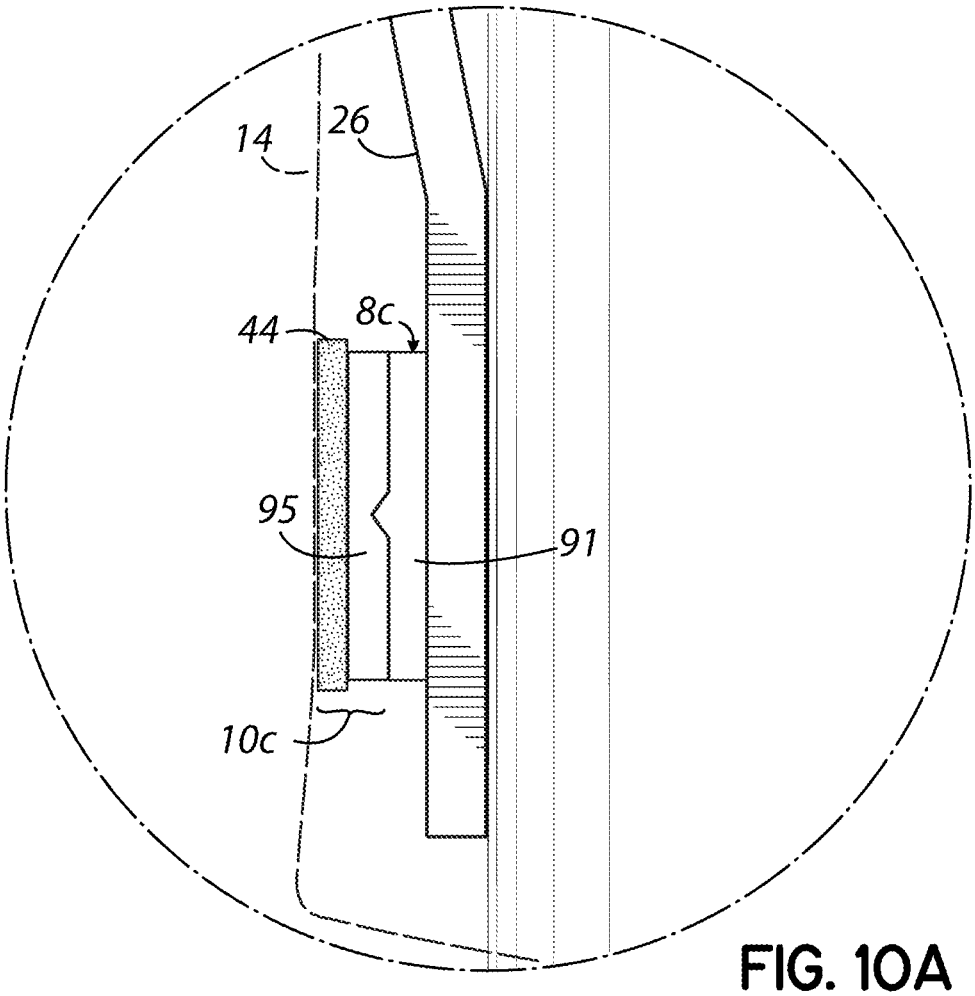
FIG. 10A is an elevation side view of the embodiment of FIG. 10, showing the two magnetic elements coupled with one another.

FIGS. 10 and 10A illustrate a portion of a concealment system including first and second magnetic elements 8*c*, 10*c* having a male-female type restraining feature made up of a wedge-like protruding portion 90 of a magnet 91 in magnetic element 8*c*, and a cooperating generally V-shaped (in cross section) recess 92 of a ferrous metallic plate 95. The shape of recess 92 is designed to at least partially receive protruding portion 90 such that, when elements 8*c* and 10*c* are magnetically engaged to one another, mechanical engagement between recess 92 and protruding portion 90 prevents or at least hinders (e.g., minimizes) sliding movement of elements 8*c* and 10*c* relative to one another. Magnet 91 of first magnetic element 8*c* in the illustrated embodiment has two wing portions and a central portion in between that includes the wedge-like protruding portion 90.

FIGS. 10 and 10A also show a schematically depicted coupler 44 similar in structure, contemplated variations thereof, and functionality of the like-numbered feature in the preceding embodiments. First magnetic element 8*c* in the exemplifying embodiment of FIGS. 10 and 10A is attached to or otherwise forms part of a plate 26 of a belt clip 20 (see FIG. 2), though it is contemplated that first magnetic element 8*c* may instead be directly attached to or be integrally formed with any other part of the body of the holster.

Figure 10B:
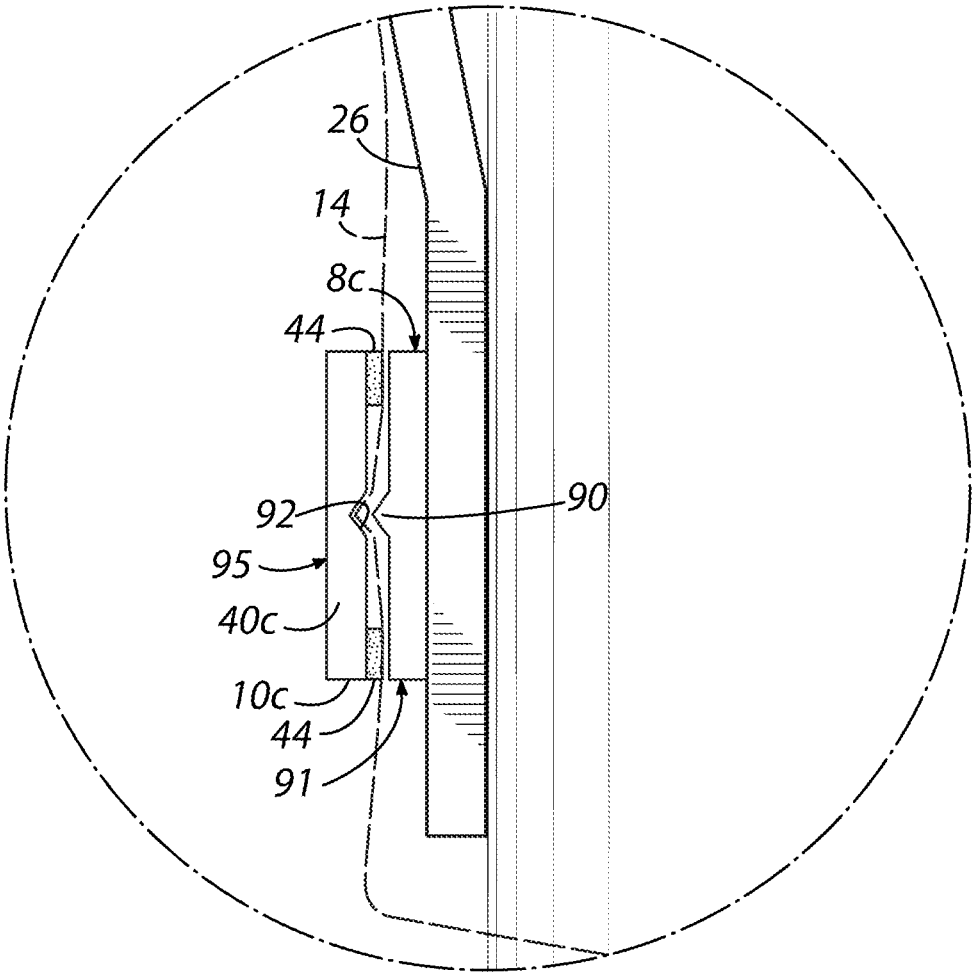
FIG. 10B is a view similar to FIG. 10A illustrating a variation of the embodiment of FIGS. 10 and 10A.

FIG. 10B shows a contemplated variation of the concealment system of FIGS. 10 and 10A, in which the second magnetic element 10*c* is coupled to an underside of the article of clothing 14 (or even be interiorly disposed between two layers of the material of which article of clothing 14 is made), rather than being attached to the exterior of article of clothing 14 and configured for direct contact and engagement with first magnetic element 8*c*. In that embodiment, the magnetic strength and number of magnets making up the first and/or second magnetic elements are suitably chosen such that the total effective magnetic pull force between those elements is sufficient to maintain them in magnetic engagement with one another irrespective of the presence of the article of clothing 14 between them. Likewise, the shape and size of recess 92 are suitably chosen to result in at least some level of mechanical engagement with protruding portion 91 with the material making up article of clothing 14 in between.

Another contemplated variation of the embodiment of FIGS. 10, 10A, and 10B, not shown, includes a first or second magnetic element having two magnets spaced from one another by a gap, with that gap defining a recess, similar in functionality to recess 92 in those figures, configured to receive protruding portion (such as protruding portion 90) for magnetic and mechanical engagement of the first and second magnetic elements with one another. While not explicitly shown, it is understood that one or more of the structures and components making up the first magnetic element 8*c* in FIGS. 10, 10A, and 10B (and contemplated variations thereof) may instead be configured for attachment to the article of clothing 14, while one or more of the structures and components making up the second magnetic element 10*c* may be attached to or form part of body 6 of the holster rather than being attached to article of clothing 14.

For example, and without limitation, the structure shown on the right side of FIG. 10 i.e., two wing portions and a centrally-located wedge-like protruding portion, may be a ferrous metallic body configured to be attached to the article of clothing 14 rather than to the body 6 of the holster. Likewise, the structure on the left side of FIG. 10 i.e., the entire body that includes the generally V-shaped recess 92 may be a magnet attached to or forming part of the body 6 of the holster and configured to cooperate with the opposing ferrous metallic body attached to the article of clothing 14.

Figure 11:
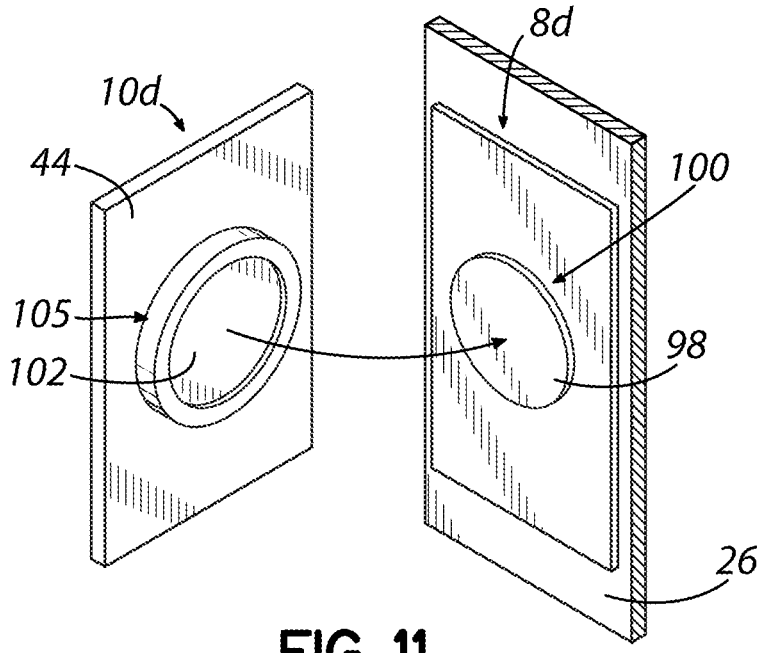
FIG. 11 is a perspective view of a pair of magnetic elements configured for magnetic and mechanical coupling with one another, in accordance with one embodiment of the invention.
Figure 11A:
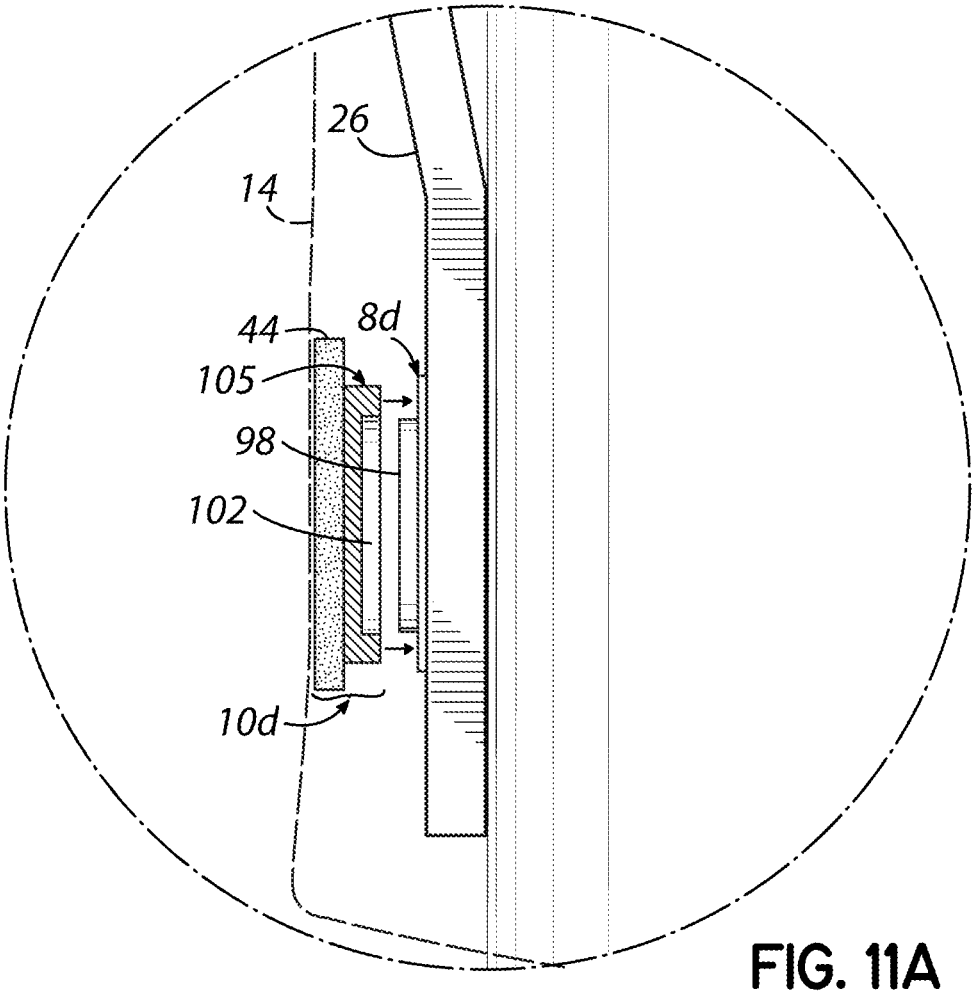
FIG. 11A is an elevation side view of the embodiment of FIG. 11, showing the two magnetic elements coupled with one another.

FIGS. 11 and 11A illustrate a portion of another embodiment of a concealment system that includes first and second magnetic elements 8*d*, 10*d* having another male-female type restraining feature made up of a disk-like protruding portion 98 of a magnet 100 in magnetic element 8*d*, and a cooperating circular recess 102 of a generally ring-shaped ferrous metallic plate 105. The shape of recess 102 is designed to at least partially receive protruding portion 98 such that, when elements 8*d* and 10*d* are magnetically engaged to one another, mechanical engagement between recess 102 and protruding portion 98 prevents or at least hinders sliding movement of elements 8*d* and 10*d* relative to one another.

FIGS. 11 and 11A also show a schematically depicted coupler 44 similar in structure, contemplated variations thereof, and functionality of the like-numbered feature in the preceding embodiments. First magnetic element 8*d* in the exemplifying embodiment of FIGS. 11 and HA is attached to or otherwise forms part of a plate 26 of a belt clip 20 (see FIG. 2), though it is contemplated that first magnetic element 8*d* may instead be directly attached to or be integrally formed with any other part of the body of the holster.

Figure 11B:
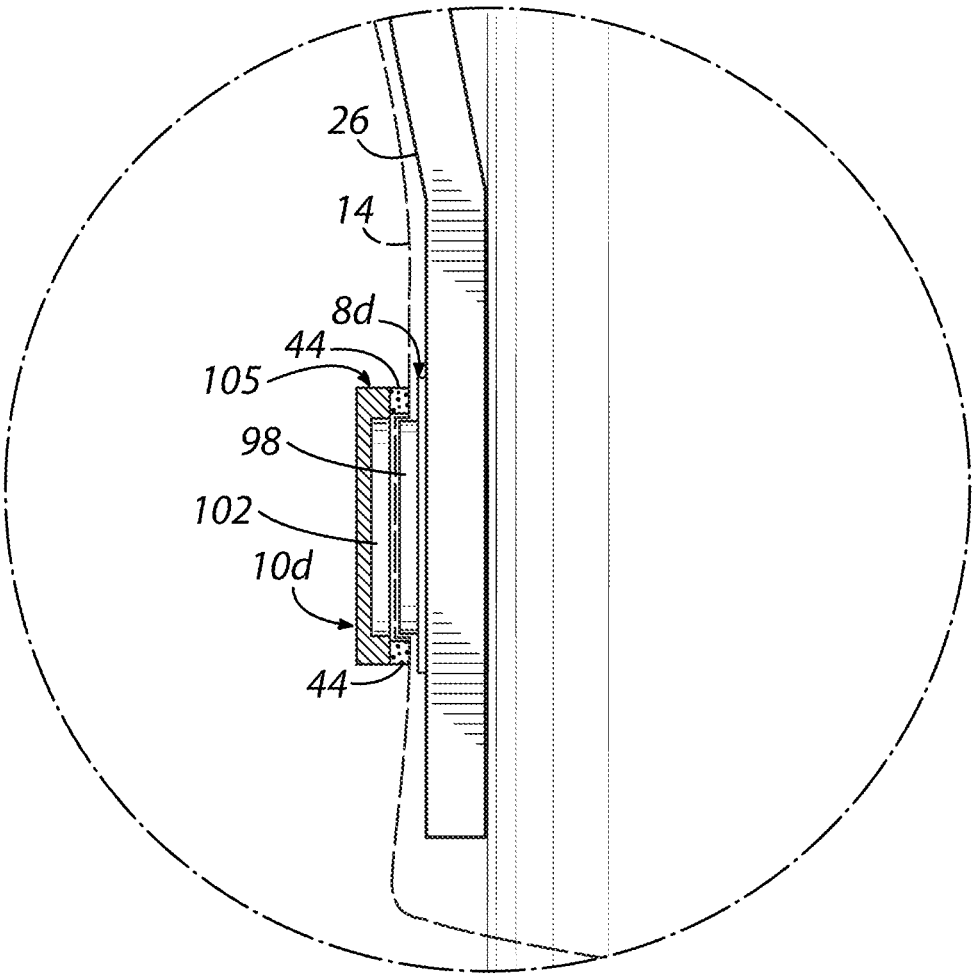
FIG. 11B is a view similar to FIG. 11A illustrating a variation of the embodiment of FIGS. 11 and 11A.

FIG. 11B shows a contemplated variation of the concealment system of FIGS. 11 and 11A, in which the second magnetic element 10*d* is coupled to an underside of the article of clothing 14 (or disposed interiorly between layers thereof), rather than being attached to the exterior of article of clothing 14 and configured for direct contact and engagement with first magnetic element 8*d*. In that embodiment, the magnetic strength and number of magnets making up the first and/or second magnetic elements are suitably chosen such that the effective magnetic force between those elements is sufficient to maintain them in magnetic engagement with one another irrespective of the presence of the article of clothing 14 between them. Likewise, the shape and size of recess 102 are suitably chosen to result in at least some level of mechanical engagement with protruding portion 98 with the material making up article of clothing 14 in between.

Figure 12:
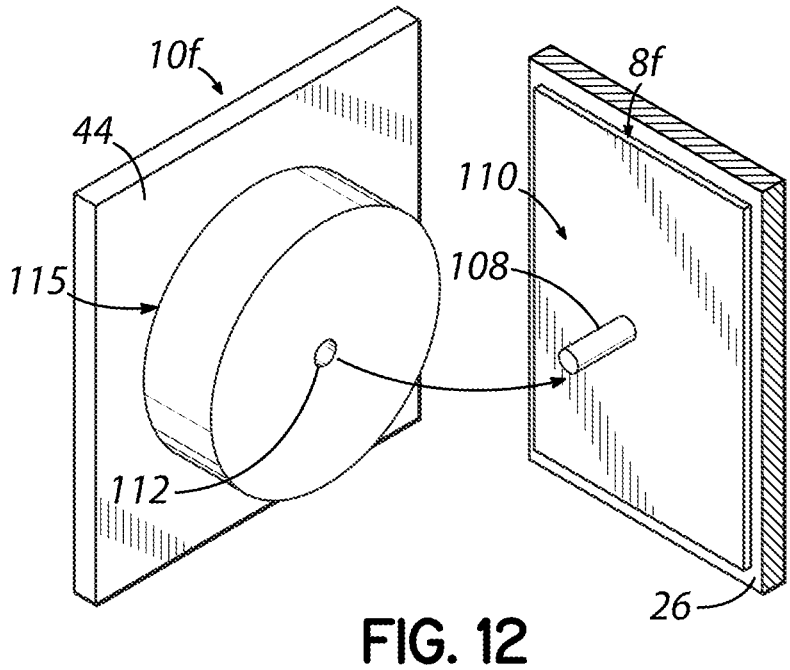
FIG. 12 is a perspective view of a pair of magnetic elements configured for magnetic and mechanical coupling with one another, in accordance with one embodiment of the invention.
Figure 12A:
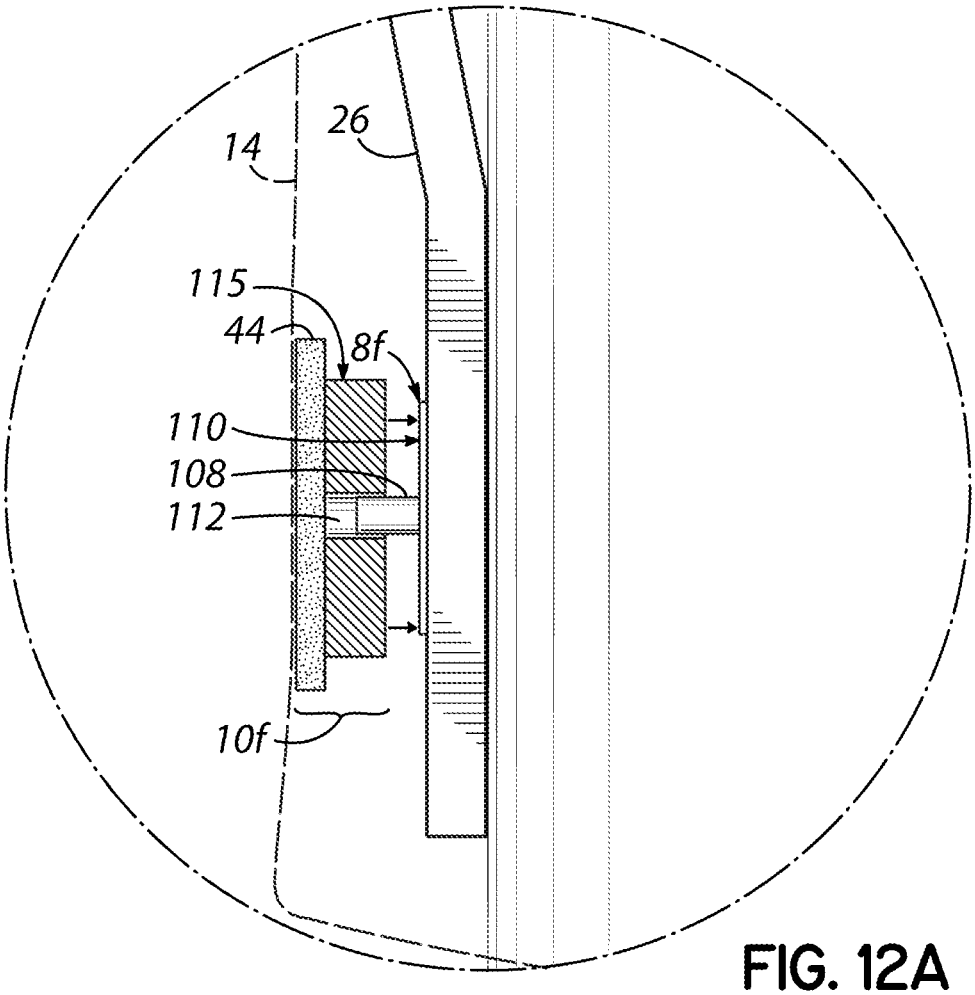
FIG. 12A is an elevation side view of the embodiment of FIG. 12, showing the two magnetic elements coupled with one another.

FIGS. 12 and 12A illustrate a portion of yet another embodiment of a concealment system that includes first and second magnetic elements 8*f*, 10*f* having another male-female type restraining feature made up of a pin-like protruding portion 108 of a magnet 110 in magnetic element 8*f*, and a cooperating circular recess 112 of a generally ring-cylindrical ferrous metallic plate 115. The shape of recess 112 is designed to at least partially receive protruding portion 108 such that, when elements 8*f* and 10*f* are magnetically engaged to one another, mechanical engagement between recess 112 and protruding portion 108 prevents or at least hinders sliding movement of elements 8*f* and 10*f* relative to one another.

FIGS. 12 and 12A also show a schematically depicted coupler 44 similar in structure, contemplated variations thereof, and functionality of the like-numbered feature in the preceding embodiments. First magnetic element 8*f* in the exemplifying embodiment of FIGS. 12 and 12A is attached to or otherwise forms part of a plate 26 of a belt clip 20 (see FIG. 2), though it is contemplated that first magnetic element 8*f* may instead be directly attached to or be integrally formed with any other part of the body of the holster.

Figure 12B:
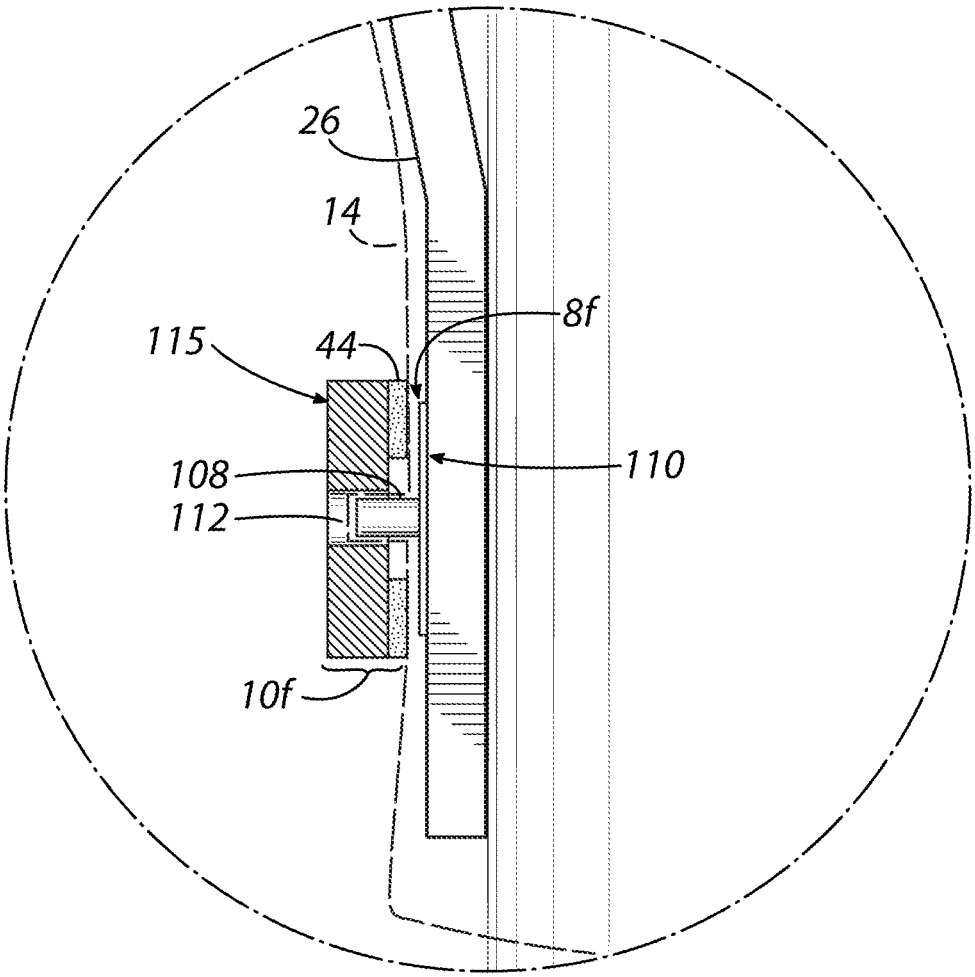
FIG. 12B is a view similar to FIG. 12A illustrating a variation of the embodiment of FIGS. 12 and 12A.

FIG. 12B shows a contemplated variation of the concealment system of FIGS. 12 and 12A, in which the second magnetic element 10*f* is coupled to an underside of the article of clothing 14 (or disposed interiorly between layers thereof), rather than being attached to the exterior of article of clothing 14 and configured for direct contact and engagement with first magnetic element 8*f*. In that embodiment, the magnetic strength and number of magnets making up the first and/or second magnetic elements are suitably chosen such that the effective magnetic force between those elements is sufficient to maintain them in magnetic engagement with one another irrespective of the presence of the article of clothing 14 between them. Likewise, the shape and size of recess 112 are suitably chosen to result in at least some level of mechanical engagement with protruding portion 108 with the material making up article of clothing 14 in between.

While not explicitly shown, it is understood that one or more of the structures and components making up the first magnetic element 8*f* in FIGS. 12, 12A, and 12B (and contemplated variations thereof) may instead be configured for attachment to the article of clothing 14, while one or more of the structures and components making up the second magnetic element 10*f* may be attached to or form part of body 6 of the holster rather than being attached to article of clothing 14.

It is contemplated that one or both of the magnetic elements in any of the embodiments associated with FIG. 10, 10A, 10B, 11, 11A, 11B, 12, 12A, 12B (or variations thereof) may include other elements or features forming part of the embodiments associated with any of the preceding figures. For example, they may include one or more layers 34 of a plastic or flexible plastic material (see e.g., FIG. 2A), and the type, number and shape of the magnets in one or both of the cooperating magnetic elements chosen to provide a total effective magnetic pull force high enough to maintain both magnetic elements in engagement with one another while worn, while being low enough to permit disengagement from one another when desired. For example, the inventor herein found that using a first magnetic element with two side-by-side magnets each having a nominal magnetic pull force no greater than about 26 Newtons permitted disengagement of the magnetic elements from one another without undue effort, particularly when a layer of the wearer's article of clothing 14 was at the interface of the two magnetic elements i.e., when the second magnetic element was coupled to the surface of the article of clothing 14 that faces away from the wearer's body.

Likewise, the inventor herein found that using a first magnetic element with two side-by-side magnets each having a nominal magnetic pull force no less than about 19 Newtons provided a sufficient magnetic strength between the first and second magnetic elements, capable of maintaining those elements engaged while avoiding inadvertent disengagement even when used with the material (e.g., cloth) of an article of clothing 14 in between. The inventor found, however, that for certain types and/or thickness of material making up the article of clothing 14, two side-by-side magnets each having a nominal magnetic pull force of about 19 Newtons was not effective at preventing inadvertent disengagement of the first and second magnetic elements from one another. Yet for other combinations of materials and construction of the first and second magnetic elements, a total effective magnetic pull force between those elements in the range between about 11 Newtons and about 35 Newtons provided an adequate balance, while for other combinations a suitable range was between about 15 Newtons and about 30 Newtons, and yet for other combinations the suitable range was found to be between about 19 Newtons and about 26 Newtons.

A suitable type of magnet for some of the embodiment described above is the model known as D63, an axially magnetized, nickel-plated neodymium magnet available from K&J Magnetics, Inc. of Pipersville, Pennsylvania Another suitable type of magnet is the model known as model DE1, an axially magnetized, nickel-plated neodymium magnet also available from K&J Magnetics, Inc. Yet another suitable type of magnet, which provided a desirable balance between sufficient magnetic strength during use while being detachable without undue force is the model known as DA1-N52. The DA1-N52 magnet is an axially magnetized, nickel-plated neodymium magnet also available from K&J Magnetics, Inc. and having a nominal magnetic pull force of about 22 Newtons. The inventors found that axially magnetized models provided a desirable combination of direction of the magnetic strength and overall shape and dimensions of the magnets used as described above (as opposed to diametrically magnetized models, for example). Further, axially magnetized models were found to be less likely to cause inadvertent magnetic engagement—when used in the embodiments described above—with metallic objects other than those intended to engage with those magnets in those embodiments.

Other contemplated embodiments—not shown in this document—include a restraining feature in which one or both of the magnetic elements have texturized surfaces or high-relief surfaces capable of providing some level of mechanical engagement with one another, thereby preventing or minimizing sliding movement of the magnetic elements relative to one another. Alternatively, the restraining feature may include one of the magnetic elements having a first set of peaks and valleys on its exterior surface configured to mechanically engage with a set of peaks and valleys on the exterior surface of the other magnetic element. Yet other contemplated embodiments (also not shown herein) include a restraining feature in which both of the magnetic elements have cooperating stepped surfaces, such that mechanical engagement between the respective steps of the magnetic elements provide at least some level of hinderance against sliding movement of the two magnetic elements relative to one another.

While not shown, it is contemplated that the principles, structure and functionality described above in connection with the specific embodiments described herein and/or illustrated in the figures are similarly applicable to the concealment of other types of weapons, such as knives, for example. Similarly, those same principles, structure and functionality are applicable to holsters, sheaths, or sleeves configured to carry such other types of weapons on the body of a person.

It is contemplated that the various embodiments and features described above, including variations thereof, may be combined with one another, even if a specific combination of features is not shown in one of the accompanying figures or described in association with one particular embodiment. From the above disclosure of the general principles of the present invention and the preceding detailed description of exemplifying embodiments, those skilled in the art will readily comprehend the various modifications to which this invention is susceptible. Accordingly, this invention is intended to be limited only by the scope of the following claims and equivalents thereof

What is claimed is:

1. A firearm holster for a person wearing a shirt hanging down over that person's waist area, comprising:

a holster body including a plurality of walls defining an encasement for the firearm and an opening for inserting the firearm into said encasement, said plurality of walls including an interior wall and an exterior wall disposed opposite said interior wall;

a first magnetic element disposed on said holster body;

a second magnetic element configured to cooperate with said first magnetic element to magnetically engage said first and second magnetic elements with one another, said second magnetic element being configured to be magnetically coupled to said first magnetic element through a portion of the shirt being worn by the person with the shirt hanging down over that person's waist area; and a restraining feature at the interface between said first and second magnetic elements and configured to hinder sliding movement of the first and second magnetic elements relative to one another when said first and second magnetic elements are magnetically coupled through the portion of the shirt being worn by the person, wherein said holster body includes a holster belt clip configured for mounting the firearm holster over a belt.

2. The firearm holster of claim 1, wherein said first magnetic element is disposed on said exterior wall.

3. The firearm holster of claim 1, wherein said first magnetic element includes at least one magnet.

4. The firearm holster of claim 3, wherein said first magnetic element has a total effective magnetic pull force not greater than 52 Newtons when tested against a flat metallic plate.

5. The firearm holster of claim 3, wherein said first magnetic element includes two magnets, each with a nominal pull force in the range between 19 Newtons and 26 Newtons and said second magnetic element includes a ferrous metallic plate and a layer of rubberized material disposed on said ferrous metallic plate.

6. The firearm holster of claim 5, wherein said layer of rubberized material includes a synthetic rubber material having a thickness between 0.2 and 0.5 millimeters.

7. The firearm holster of claim 1, wherein said restraining feature includes a male element in one of the first or second magnetic elements and a cooperating female element in the other of the first or second magnetic elements for receiving said male element therein when said first and second magnetics elements are coupled to one another.

8. The firearm holster of claim 1, wherein said restraining feature includes a first stepped surface on one of the first or second magnetic elements and a complementary second stepped surface on the other of the first or second magnetic elements or a texturized surface on one or both of said first and second magnetic elements.

9. The firearm holster of claim 1, wherein said first magnetic element is free of magnets.

10. The firearm holster of claim 1, wherein said first magnetic element is integrally formed with said holster body.

11. The firearm holster of claim 1, wherein said first magnetic element is permanently attached to said holster body.

12. The firearm holster of claim 1, wherein said first magnetic element is releasably attached to said holster body.

13. The firearm holster of claim 1, wherein said first magnetic element is disposed on said holster belt clip.

14. The firearm holster of claim 1, wherein said second magnetic element includes a coupler for coupling said second magnetic element to the shirt, said coupler including one of a hook-and-loop fastener, a snap fastener, a temporary adhesive, a clamp, or a resilient clip configured to releasably couple said second magnetic element to the article of clothing.

15. A firearm holster for a person wearing a shirt hanging down over that person's waist area, comprising:

a holster body including a plurality of walls defining an encasement for the firearm and an opening for inserting the firearm into said encasement, said plurality of walls including an interior wall and an exterior wall disposed opposite said interior wall;

a first magnetic element disposed on said holster body and including a pair of magnets, each of said magnets having a nominal pull force between 19 Newtons and 26 Newtons;

a second magnetic element configured to cooperate with said first magnetic element to magnetically engage said first and second magnetic elements with one another, said second magnetic element including a ferrous metallic plate configured for magnetic engagement with said pair of magnets of said first magnetic element-, said second magnetic element being configured to be magnetically coupled to said first magnetic element through a portion of the shirt being worn by the person with the shirt hanging down over that person's waist area; and a restraining feature at the interface between said first and second magnetic elements and configured to hinder sliding movement of the first and second magnetic elements relative to one another when said first and second magnetic elements are magnetically coupled through the portion of the shirt being worn by the person, wherein said holster body includes a holster belt clip configured for mounting the firearm holster over a belt.

* * * * *